US005931665A

United States Patent [19]

Wada et al.

[11] Patent Number: 5,931,665

[45] Date of Patent: Aug. 3, 1999

[54] FURNACE FOR FIRING A GLASS-LINED PRODUCT

[75] Inventors: Hiromi Wada; Masamitsu Sawada, both of Hyogo-ken, Japan

[73] Assignee: Shinko Pantec Co., Ltd., Hyogo-ken, Japan

[21] Appl. No.: 08/883,603

[22] Filed: Jun. 26, 1997

[30] Foreign Application Priority Data

Dec. 17, 1996 [JP] Japan ..... 8-337185
Jun. 13, 1997 [JP] Japan ..... 9-157001

[51] Int. Cl.[6] ..... H05B 3/62

[52] U.S. Cl. ..... 432/209; 373/119; 373/114; 373/118

[58] Field of Search ..... 373/110, 114, 373/119, 1, 118; 432/209; 219/430, 400; 266/250

[56] References Cited

U.S. PATENT DOCUMENTS 2,466,409 4/1949 Gardes ..... 219/400
2,966,537 12/1960 Witucki et al. ..... 373/114
3,404,210 10/1968 Weber ..... 373/119
3,622,135 11/1971 Bauer et al. ..... 432/209
4,093,816 6/1978 Case ..... 373/1

*Primary Examiner*—Teresa Walberg
*Assistant Examiner*—Quang Van
*Attorney, Agent, or Firm*—Oblon, Spivak, McClelland, Maier & Neustadt, P.C.

[57] ABSTRACT

A batch type furnace includes a furnace body, a floor being removably attachable to the furnace body for forming a furnace chamber, and radiant tubes being substantially and uniformly arranged in the furnace body and the floor. The radiant tubes are controllable to a predetermined temperature independently of each other. The radiant tubes are made of an alloy having a heat resistance of such a degree as to tolerate quick heating and cooling.

15 Claims, 8 Drawing Sheets

T1 : TIME AT WHICH THE FIRING OF THE FLOOR 2 COMMENCES

T2 : TIME AT WHICH THE FIRING OF THE FURNACE BODY 1 COMMENCES
(TEMPERATURE DIFFERENCE : 50 DEGREES C.)

T3 : TIME AT WHICH THE TEMPERATURES OF THE FURNACE BODY 1 AND THE FLOOR 2 BECOME EQUAL TO EACH OTHER t5 : TEMPERATURE AT THE SIDE OF THE FURNACE BODY 1 t6 : TEMPERATURE AT THE SIDE OF THE FLOOR 2

FIG. 10

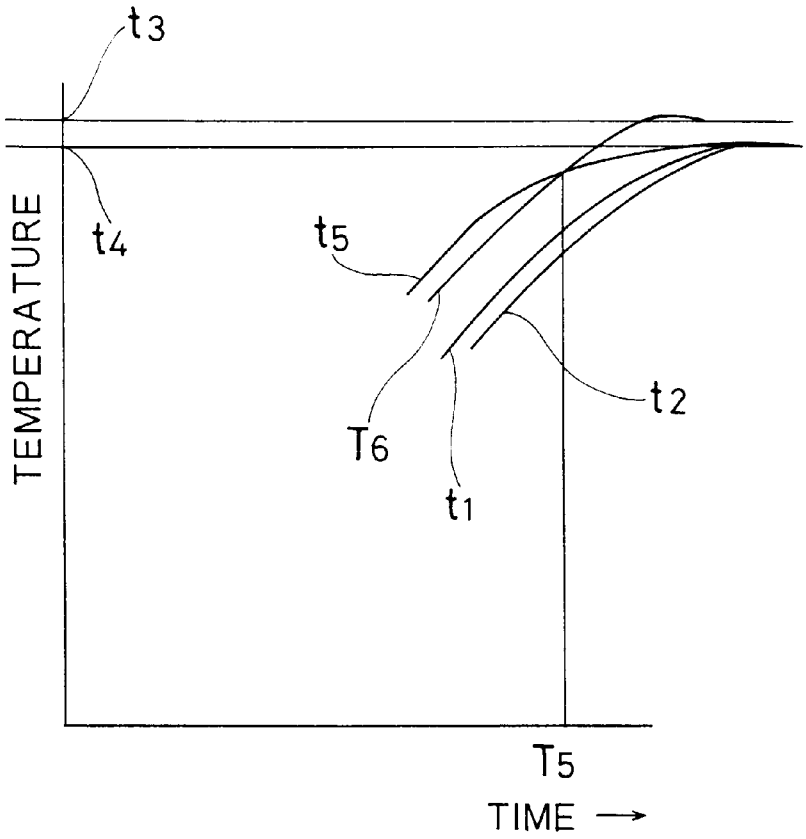

$t_1$: TEMPERATURE AT AN UPPER PORTION OF THE ARTICLE $t_2$: TEMPERATURE AT A LOWER PORTION OF THE ARTICLE $t_3$: SETTING TEMPERATURE OF THE FLOOR 2

$t_4$: SETTING TEPERATURE OF THE FURNACE BODY 1

$t_5$: TEMPERATURE AT THE SIDE OF THE FURNACE BODY 1

$t_6$: TEMPERATURE AT THE SIDE OF THE FLOOR 2

$T_5$: TIME AT WHICH THE TEMPERATURES OF THE FLOOR 2 AND THE FURNACE BODY 1 BECOME EQUAL TO EACH OTHER

FURNACE FOR FIRING A GLASS-LINED PRODUCT

BACKGROUND OF THE INVENTION

1. Field of the Invention

This invention relates to a furnace, and more particularly a furnace for firing a glass-lined product.

2. Description of the Prior Art

There have been provided various furnaces which are categorized broadly into a burner type and an electrical type in heating system, and a batch type and a continuous type in operation system. Among these types, a suitable type is selected in accordance with a kind of an article to be fired.

A glass-lined product is manufactured through a process of spraying a ground coat or a cover coat on a metal surface of the article, drying and firing such coated article. More particularly, the article which has been coated and dried is generally fired by a quick heating within a furnace chamber, and subsequently cooled after it is withdrawn from the furnace chamber.

If contamination is caused on a glass surface of the article during repetition of the spraying, drying and firing process, corrosion resistance of a finished glass-lined product may be deteriorated.

Accordingly, atmosphere within the furnace chamber must be kept in clean state to properly fire the glass-lined product. However, the furnace of the burner type involves a problem that combustion gas of a burner may cause some damages against the glass-lined surface of the product, and further cause foreign matters to be spread over inside of the furnace chamber and stuck on the article.

As far as is known it is essential that the agitation is not performed within the furnace chamber to avoid the foreign matters from spreading over the inside of the furnace chamber, which may cause deterioration of the glass-lined product, and that a uniform temperature distribution is provided throughout the entire region of the furnace chamber, when the glass-lined product is to be fired within the furnace chamber of the burner type.

In view of the foregoing considerations and problems, it was a common practice that the glass-lined product is fired by the electric furnace.

As an additional limitation in selecting the furnace of the type suitable for firing the glass-lined product, the glass-lined product does not commonly have a uniform construction, but a customized construction which is not suitable for mass-production, where a lot of the articles with uniform construction are successively fired. Accordingly, the glass-lined product is generally fired by the batch type furnace.

However, the electric furnace involves a problem that it rises an energy cost, and therefore is not economical in operation.

To keep the atmosphere within the furnace chamber of the burner type in clean state, a construction with a radiant tube is employed in some cases, where a centrifuged-casting pipe is commonly used as a material for the radiant tube. However, the centrifuged-casting pipe is usually formed by a thicker wall which may reduce a quick heat transfer and increase the weight of the radiant tube, which renders the radiant tube of the centrifuged-casting pipe unsuitable for firing of the glass-lined article, because a high precision temperature control is required to quickly heat the glass-lined article to a temperature at which the glass-lined article is fired, and perform other heating operations.

As an inherent characteristic of the batch type furnace in operation, the inside of the furnace chamber is cooled whenever the article is placed into and out of the furnace chamber. Such quick heating and cooling required in the firing of the glass-lined article causes a relatively large temperature difference for every batch, and such temperature difference frequently and repeatedly occurs. As a result, it was likely that the centrifuged-casting pipe splits due to temperature stress in a relatively short period of time.

To solve the problems as described above, it is an object of the present invention to provide a furnace of the burner type being capable of exhibiting a high heat efficiency, proceeding the heating operation under clean atmosphere, applying heat uniformly within the entire region of the furnace chamber, as well as being operated without problems under the condition of the quick heating and cooling operation.

SUMMARY OF THE INVENTION

In accordance with the above objects, a batch type furnace includes a furnace body, a floor being removably attachable to the furnace body for forming a furnace chamber, and radiant tubes being substantially and uniformly arranged in the furnace body and the floor. The radiant tubes are controllable to a predetermined temperature independently of each other. The radiant tubes are made of an alloy having a heat resistance of such a degree as to tolerate quick heating and cooling.

In accordance with the batch type furnace of the above arrangement, where the radiant tubes are substantially and uniformly arranged in the furnace body and the floor. Whereby, a uniform temperature distribution can be maintained throughout the entire furnace chamber to substantially and uniformly fire the article to be fired, even if the furnace of a burner type is employed. As a result, it is not necessary to agitate the inside of the furnace chamber.

The radiant tubes are made of an alloy having a heat resistance of such a degree as to tolerate quick heating and cooling, which renders the furnace suitable for firing the glass-lined product, and maintains a quality of the glass-lined product which has been fired.

In addition, combustion gas of the burner for heating the furnace chamber, foreign matters or the like is not introduced into the furnace chamber, but passes through the radiant tubes. As a result, the atmosphere within the furnace chamber can be kept in clean state. Since the radiant tubes transfer the heat in the form of radiant heat which has an excellent heat transfer rate, heating time can be shortened as compared with the heating method by a conventional burner. In addition, the radiant tubes has a relatively large capacity of radiating heat, as compared with the electric furnace so that heating time can be shortened. Accordingly, it is possible to shorten the time for heating the glass-lined product at a firing temperature (near the melting point of glass). As a result, it is unlikely to cause defects in the glass lining due to the firing.

In addition, since it is not necessary to perform agitate within the furnace chamber, foreign matters within the furnace chamber are unlikely to float and attach to a surface of the article to be fired. Accordingly, it is unlikely to deteriorate the corrosion resistance of the glass-lined product which is made via the coating, drying and firing processes.

As a result of the above effects, the shortcomings of the burner type can be eliminated. Accordingly, running cost can be remarkably reduced as compared with the electric furnace mainly employed for firing the glass-lined product.

The above, and other objects, features and advantages of the present invention will become apparent from the detailed description thereof read in conjunction with the accompanying drawings.

BRIEF DESCRIPTION OF THE DRAWINGS

FIG. 10 is a graph illustrating a relationship between a firing time and a temperature of an article to be fired.

DETAILED DESCRIPTION OF THE PREFERRED EMBODIMENTS

Figure 1:
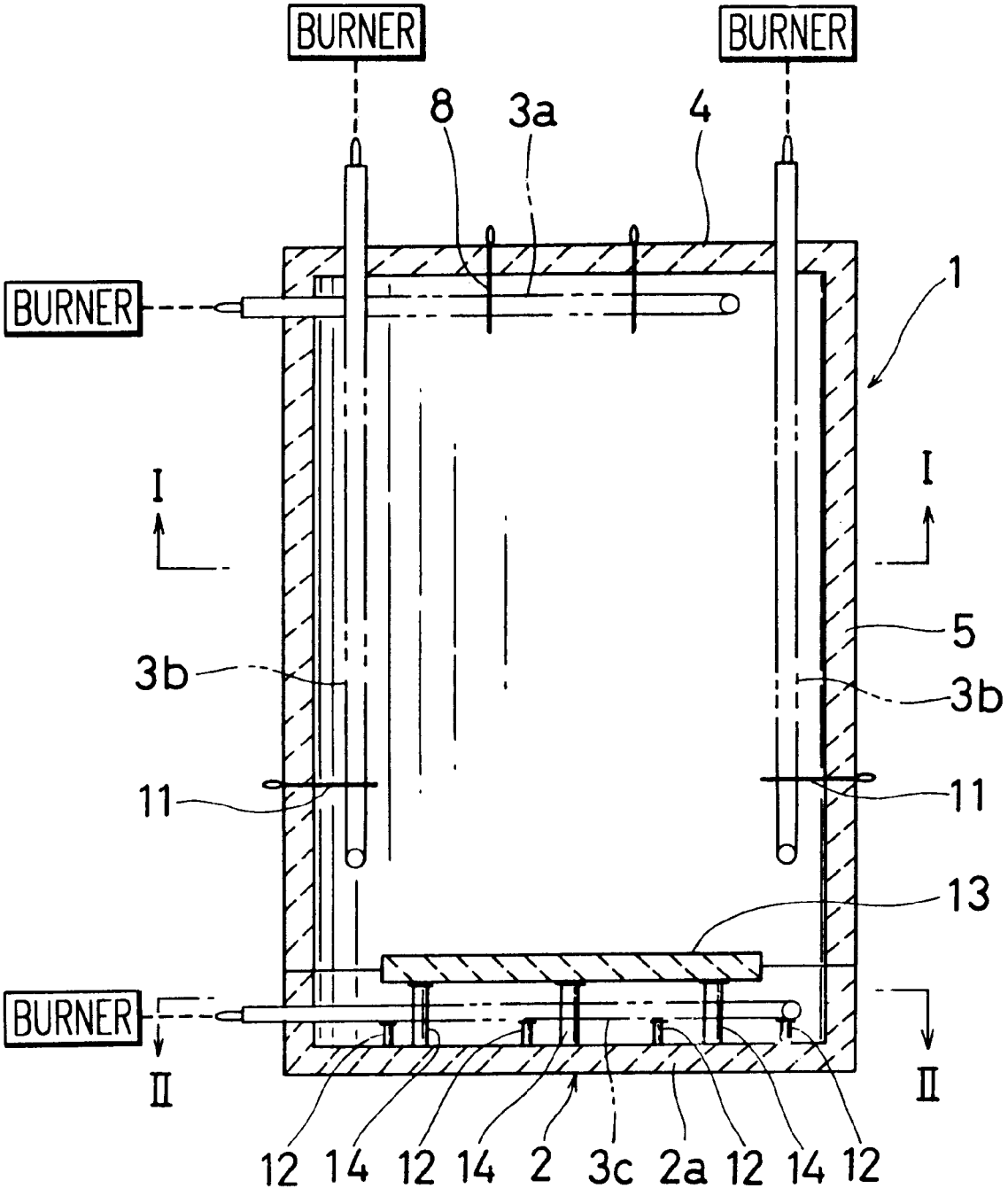
FIG. 1 is a front elevational view with a partial cross section illustrating a furnace in accordance with one embodiment of the present invention.
Figure 2:
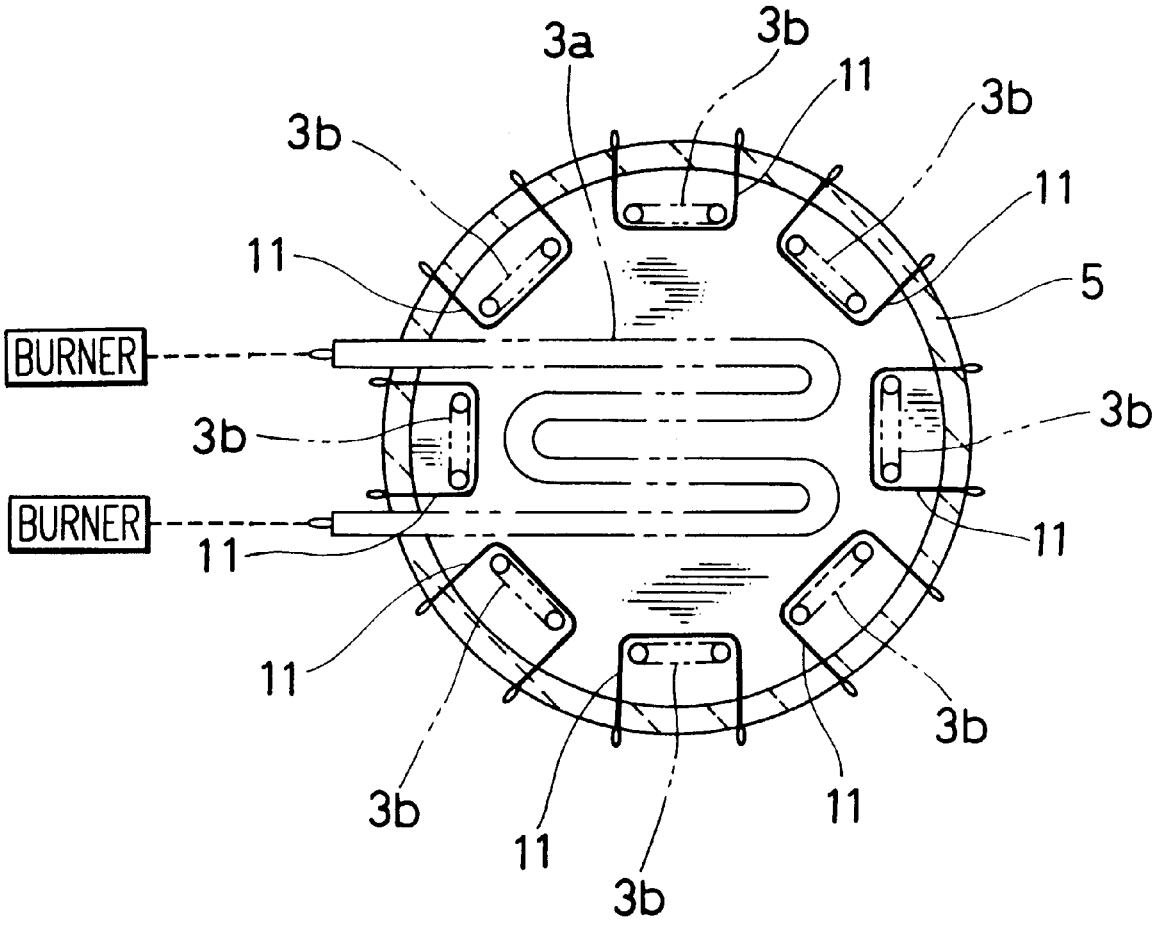
FIG. 2 is a cross section taken along a line of I—I of FIG. 1.
Figure 4:
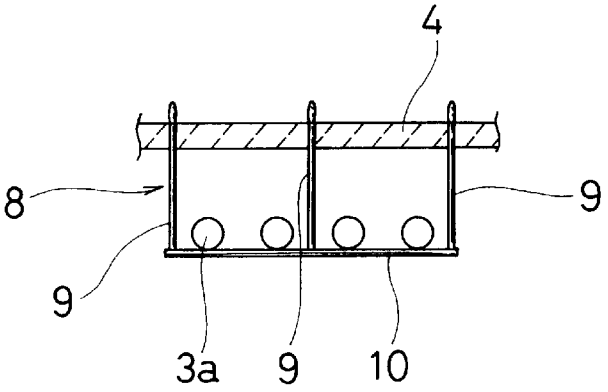
FIG. 4 is an enlarged fragmentary cross section illustrating the supporting state of radiant tubes near a top wall of the furnace.
Figure 3:
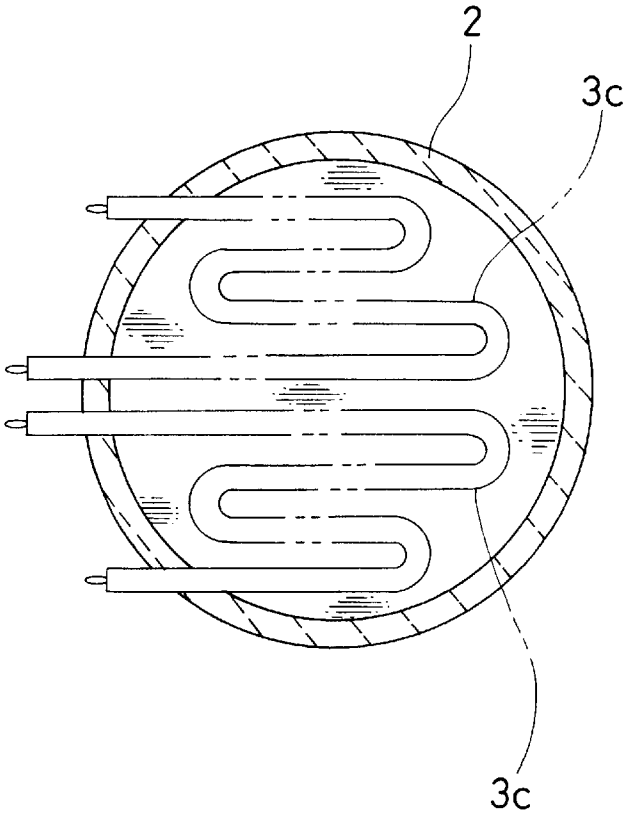
FIG. 3 is a cross section taken along a line of II—II of FIG. 1.

As illustrated in FIGS. 1 and 2, a furnace body 1 is formed into a substantially bell shape which opens downwards, and a floor 2 is provided in such a manner as to be removably attachable to the furnace body 1 via its elevational movement to form a furnace chamber in cooperation with the furnace body 1, as illustrated in FIG. 3. A ceramic wool as an insulation material is embedded in the furnace body 1 and the floor 2. Radiant tubes are installed in each of the furnace body 1 and the floor 2 in such a manner as to be substantially and uniformly arranged throughout the entire furnace chamber. A more specific arrangement of the radiant tubes will be described hereinbelow.

One radiant tube 3*a* of a substantially W-shape is installed on a top wall 4 of the furnace body 1 by a support fixture 8. More specifically, the support fixture 8 includes suspended portions 9 which are suspended from the top wall 4, and a mounting portion 10 crossing the suspended portions 9 to be supported by the suspended portions 9. The radiant tube 3*a* is mounted on the mounting portion 10 to be suspended from the top wall 4.

Portions of the radiant tube near their respective open ends are fixed to a side wall 5 of the furnace body 1 so that the residual portion of the radiant tube 3*a* which is merely mounted on the mounting portion 10 of the support fixture 8 is kept in free state.

Eight radiant tubes 3*b*, each having a substantially U-shape, are installed on the side wall 5 of the furnace body 1 with equal spacing. These radiant tubes 3*b* on the side wall 5 are also supported by support fixtures 11, as illustrated in FIGS. 1 and 2. More specifically, each of the support fixtures 11 has a substantially U-shape in cross section, the opposite ends of which are fixed to the side wall 5. The radiant tubes 3*b* are respectively loosely fitted into spaces between the support fixtures 11 and the side wall 5. Portions of each radiant tube 3*b* near their respective open ends are fixed to the top wall 4 so that the residual portions of the radiant tubes 3*b* which are merely loosely supported by the support fixture 11 are kept in free state.

Figure 5:
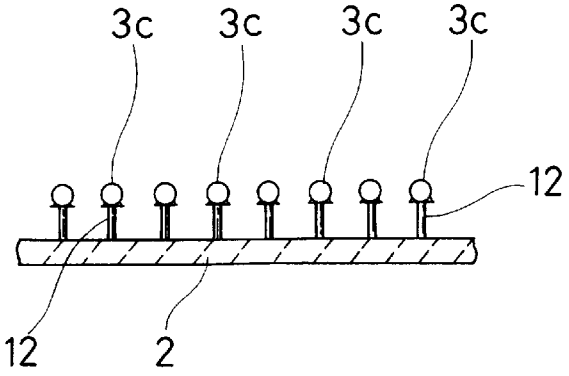
FIG. 5 is an enlarged fragmentary cross section illustrating the supporting state of the radiant tubes near a floor of the furnace.

Two radiant tubes 3*c*, each having a substantially W-shape are installed on the floor 2, as illustrated in FIG. 3. More specifically, the floor 2 includes a floor body 2*a* and a mounting plate 13 for mounting the article thereon. The radiant tubes 3*c* are incorporated in a space between the floor body 2*a* and the mounting plate 13, and are supported by support fixtures 12, as illustrated in FIG. 5. More specifically, the radiant tubes 3*c* rest on the support fixtures 12 which protrude upwardly from the floor 2. Portions of the radiant tubes 3*c* near their respective open ends are fixed to the side wall so that the residual portions of the radiant tubes 3*b* which merely rest on the support fixtures 12 are kept in free state.

Thus, the radiant tubes 3*a*, 3*b* and 3*c* are substantially and uniformly arranged in the furnace body 1 and the floor 2. By "uniformly arranged in the furnace body 1 and the floor 2", it is not meant that substantially the same numbers of the radiant tubes are arranged in each of the furnace body 1 and the floor 2.

In this embodiment, the radiant tubes are arranged so that the radiant tube 3*a* in the top wall 4 is equivalent to 10% of the gross combustion energy, the radiant tubes 3*b* in the side wall 3*b* are equivalent to 60% and the radiant tubes 3*c* in the floor 2 are equivalent to 30%. The thus arranged radiant tubes 3*a*, 3*b* and 3*c* are controllable to a predetermined temperature independently of each other so that an article to be fired can uniformly be heated regardless of its shape and dimension.

The independent temperature control is advantageous in the fact that, for example, when the article is to be heated again after it is heated and cooled outside of the furnace chamber, the floor 2 which usually cooled down to the lowest temperature among the components of the furnace can independently be pre-heated. Thus, the firing can effectively be performed under various operational conditions via the independent temperature controlling of the radiant tubes 3*a*, 3*b* and 3*c*.

The radiant tubes 3*a*, 3*b* and 3*c* are made of an alloy having a heat resistance of such a degree as to tolerate quick heating and cooling operation. In this embodiment, the alloy preferably includes nickel, chromium and tungsten.

Burners (not shown) are attached not only to either one of open ends of each radiant tube, but also to both open ends thereof, and operable in such a manner as to be alternately fired at respective ends. More specifically, the burners at both open ends of each radiant tube are alternately shifted to a combustion side and exhaustion side so that the flows of the combustion gas fed from the burners at both open ends of each radiant tube are alternately directed to the reverse side.

The burners of the radiant tubes are respectively provided therein with heat reserving members (not shown) to recover exhaust heat and then utilize the same to heat air for the combustion so that the air for the combustion of a high temperature can be fed. Each of the heat reserving members has functions of recovering exhaust heat from exhaust gases in the burner of the exhaustion side, and heating the air for the combustion in the burner of the combustion side.

Figure 6:
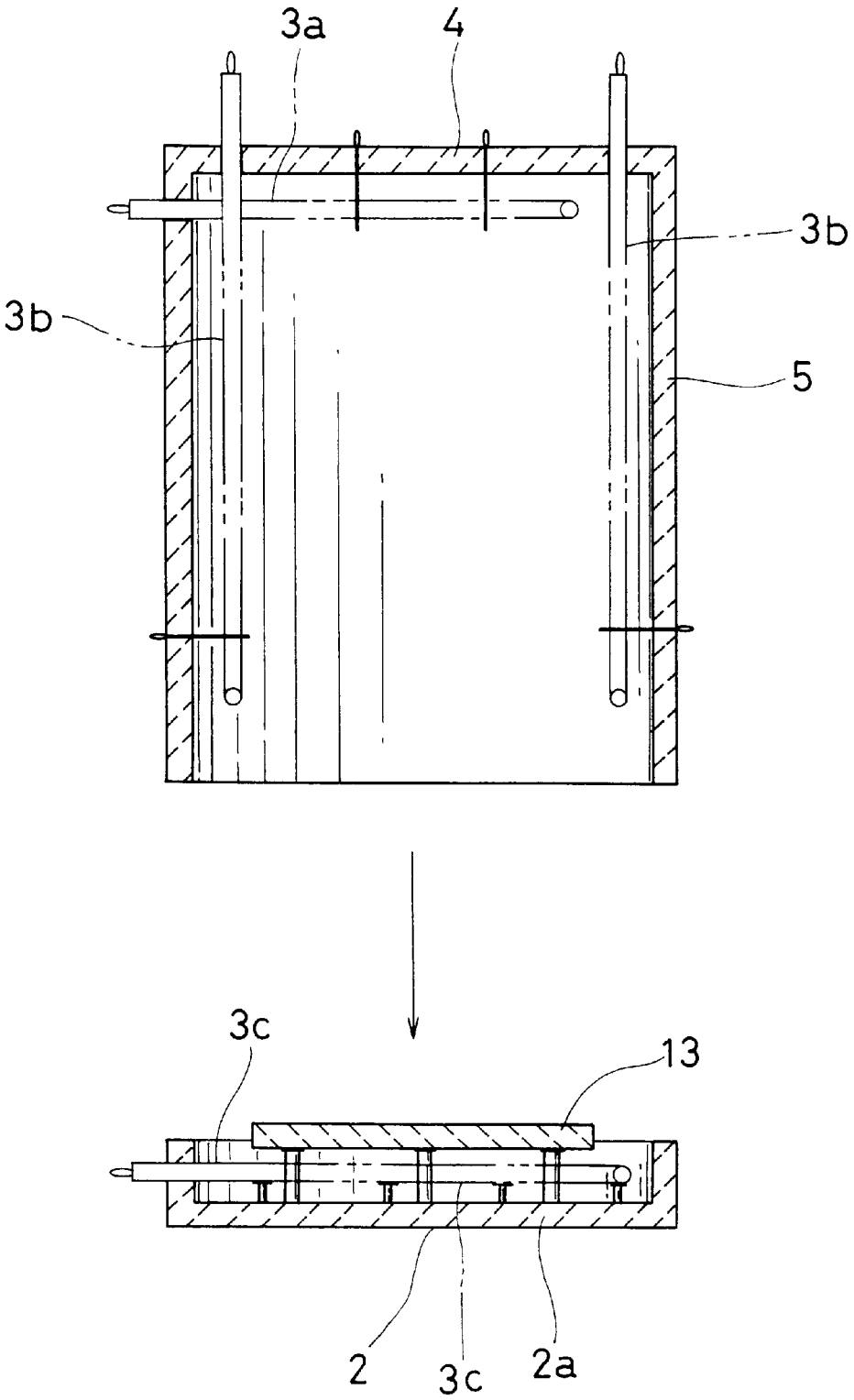
FIG. 6 is a front elevational view with a partial cross section illustrating an operational step of the furnace, in which the floor of the furnace is lowered.
Figure 7:
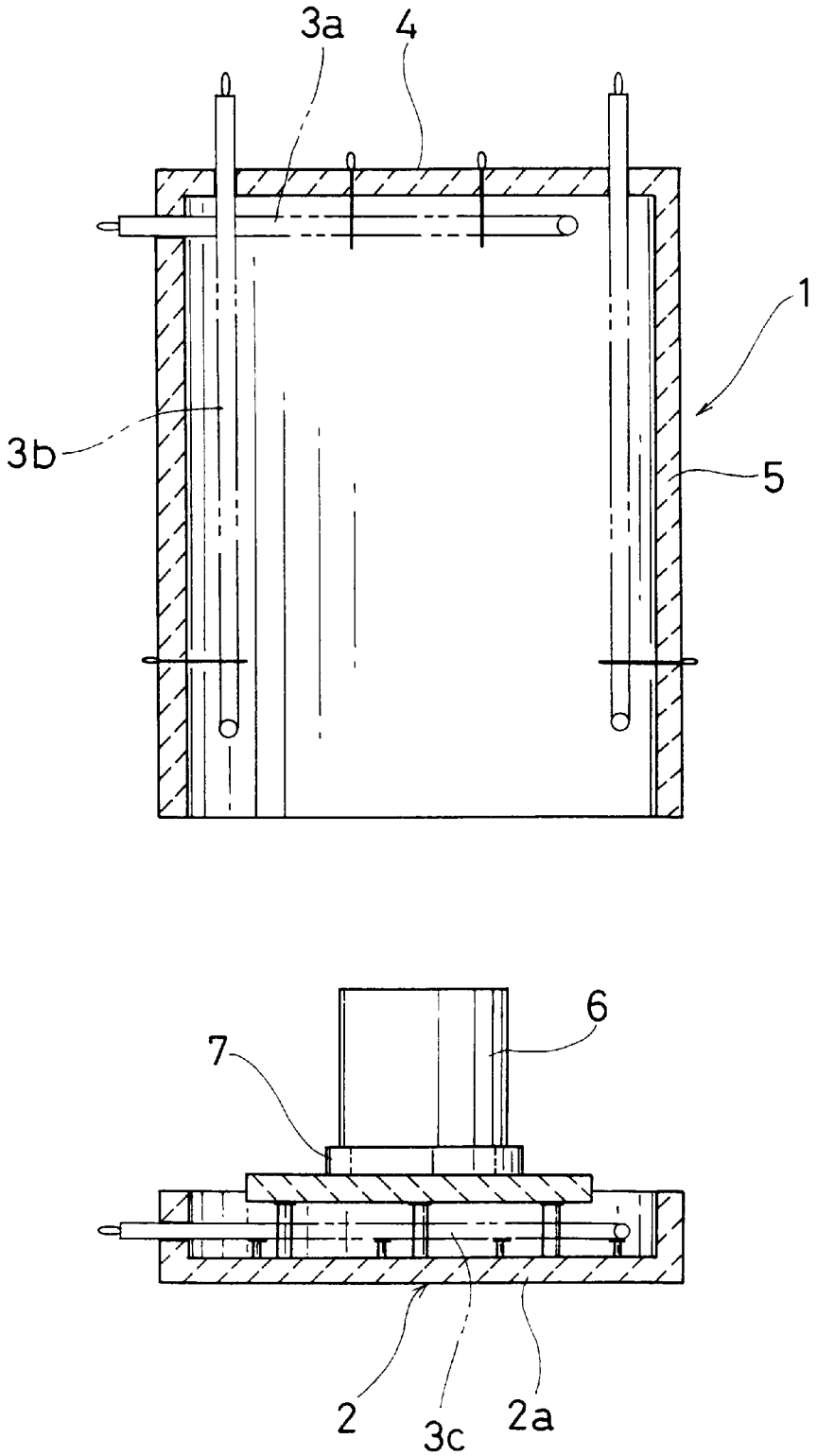
FIG. 7 is a front elevational view with a partial cross section illustrating another operational step, in which an article to be fired is mounted on the floor.

When the furnace of the above arrangement is to be used, the floor 2 is first removed from the furnace body 1 via its downward motion, as illustrated in FIG. 6. A support 7 of a substantially ring shape is, then, placed on the mounting plate 13 of the floor 2, and a vessel 6 as the article to be fired is placed on the support 7. Prior to being placed on the support 7, the vessel 6 is provided thereon with a ground coat or a cover coat which is sprayed on the vessel 6, and then dried.

Figure 8:
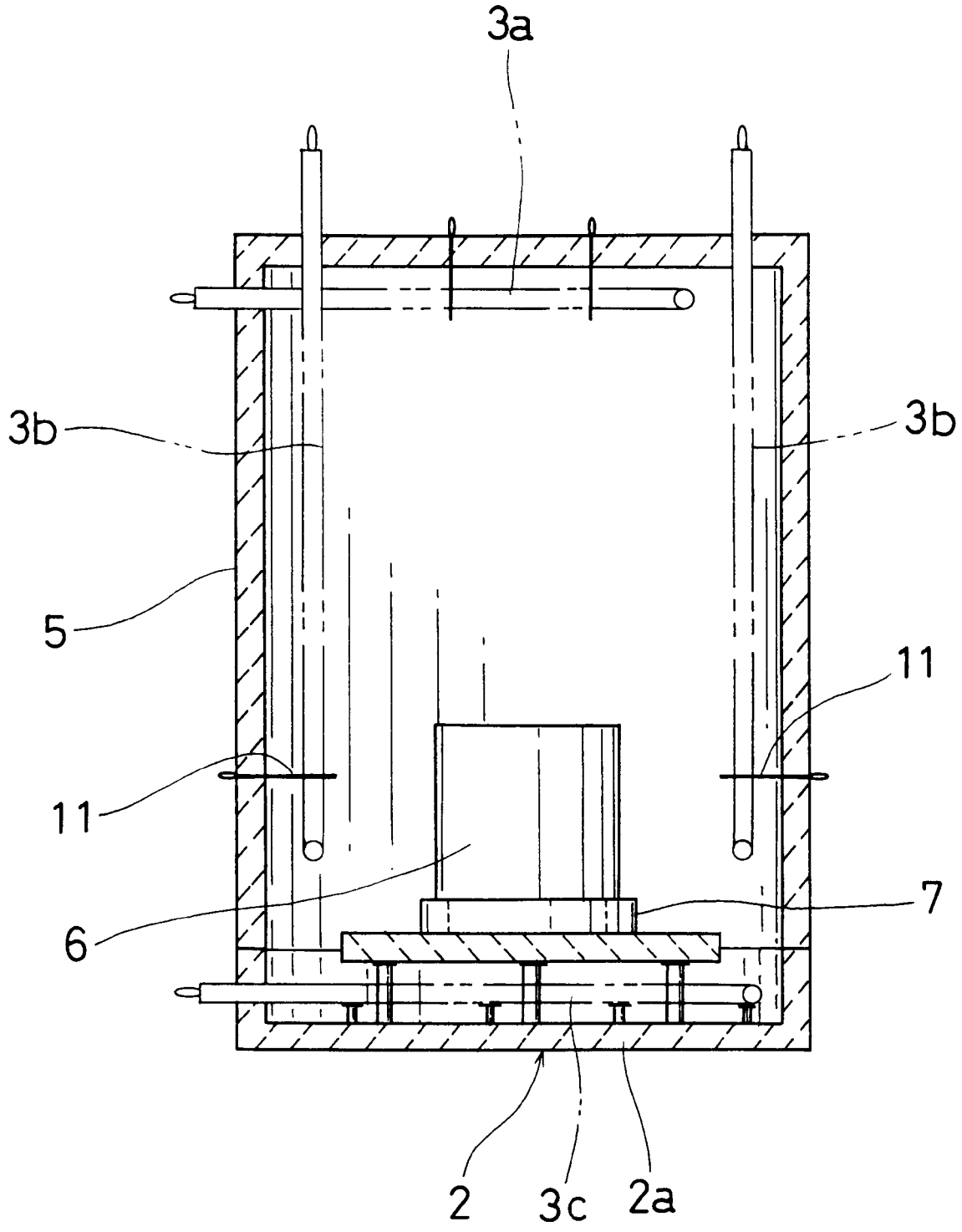
FIG. 8 is a front elevational view with a partial cross section illustrating still another operational step, in which the article to be fired is placed inside of the furnace chamber.

The floor 2 is then attached to the furnace body 1 via its upward motion to form the furnace chamber in cooperation with the furnace body 1, as illustrated in FIG. 8. Then, the burners (not shown) are activated by feeding gaseous fuel and the air for the combustion to the burners so that the gaseous fuel is combusted within the radiant tubes 3*a*, 3*b* and 3*c* to heat the vessel 6 which is now positioned inside of the furnace chamber. In accordance with this arrangement, since the heating via the burners is performed by combusting the gaseous fuel within the radiant tubes 3*a*, 3*b* and 3*c*, intrusion of combusted gas, foreign matters and other undesirable matters into the furnace chamber of the furnace is completely avoidable. As a result, the atmosphere within the furnace chamber can be kept in clean state.

The furnace of the present invention is also advantageous in the fact that the vessel 6 is substantially and uniformly heated and fired by radiant heat from the entire region of the furnace chamber. As described above, this uniform heating is accomplished by the uniform arrangement of the radiant tubes, where the radiant tube 3*a* in the top wall 4 is equivalent to 10% of the gross combustion energy, the radiant tubes 3*b* in the side wall 3*b* are equivalent to 60% and the radiant tubes 3*c* in the floor 2 are equivalent to 30%, and by controlling the radiant tubes 3*a*, 3*b* and 3*c* to a predetermined temperature independently of each other.

In addition, the radiant tubes 3*a*, 3*b* and 3*c* of the heat resistant alloy which preferably includes nickel, chromium and tungsten in this embodiment tolerate quick heating and cooling, which renders the furnace suitable for firing the glass-lined product as the vessel 6.

Since each of the radiant tubes 3*a*, 3*b* and 3*c* has a wall thickness being about one third of a centrifuged-casting pipe which is generally used for the radiant tube, a response time to the temperature controlling is shortened and a high precision temperature controlling can be accomplished. In addition, the heat efficiency of the furnace can be improved.

To uniformly heat the article, the radiant tubes 3*c* in the floor 2 are previously heated to a predetermined temperature, and the radiant tubes 3*a* and 3*b* in the furnace body 1 are then heated. In this embodiment, after the floor 2 has been heated to a temperature which is 50 degrees C. higher than that of the furnace body 1, the burners of the radiant tubes 3*a* and 3*b* on the top wall 4 and the side wall 5 are fired.

The radiant tubes in the floor 2 are independently and previously heated for reasons explained below.

Whenever the article is placed into and out of the furnace chamber, the floor 2 cools down to a temperature lower than the furnace body 1 via heat radiation. In addition, a fire resistant member of a large heat volume which is placed on the floor 2 to support the article cools down whenever the article is placed into and out of the furnace body. This also delays the temperature up within the furnace chamber. In addition, when the article of a relatively small dimension is to be fired, the heat loss in the floor 2 is increased. Accordingly, the uniform temperature distribution is hardly obtained.

In accordance with the reasons above, after the heat is repeatedly applied within the furnace chamber, the temperature at the side of the floor 2 is necessarily lowered to the temperature at the side of the furnace body 1, and the temperature difference between both sides can not be eliminated. Under this condition, the simultaneous firing of the burners of the radiant tubes in the floor 2 and the furnace body 1 causes the floor 2 and the furnace body 1 to be heated, while the temperature difference therebetween not only remains but also is widened.

Particularly, the glass-lined product is fired by quick heating, which means that the firing is performed as short as possible within the limit of the capability of the furnace to obtain a high quality of the glass-lined product. For this reason, the furnace is operated at full power to raise the temperature inside of the furnace chamber.

Figure 9:
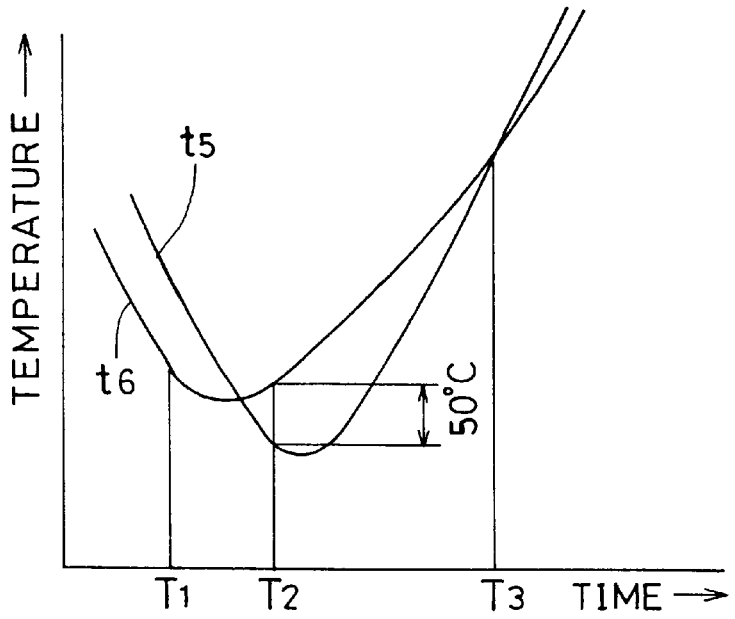
FIG. 9 is a graph illustrating a relationship between a firing time and an ambient temperature of a furnace chamber of the furnace.

Accordingly, since the burners of the top wall 4 and the side wall 5 of the furnace body 1, and the floor 2 are fired at full power, the temperature difference between the floor 2 and the furnace body 1, which may be caused as described above, is hardly corrected during the temperature rise. The power saving for the top wall 4 and the side wall 5 of the furnace body 1 to correct this temperature difference elongates the period of time for the temperature rise. Therefore, the step of firing the burners for the radiant tubes 3*c* in the floor 2 precedes the step of firing the burners for the radiant tubes 3*a* and 3*c* in the furnace body 1 so that the temperature of the floor 2 rises at first. However, the top wall 4 and the side wall 5 of the furnace body 1 shows a more remarkable temperature rise of furnace atmosphere as compared with the floor 2, since the heated air moves upward. Accordingly, even if the temperature at the side of the floor 2 is heated at first, the temperature difference between the side of the floor 2 and the side of the furnace body 1 becomes gradually smaller, and is consequently eliminated so that the temperatures at the sides of the floor 2 and the furnace body 1 becomes equal to each other. This will be described with reference to FIG. 9 as follows.

A commencing time $T_1$ of the firing of the floor 2 precedes a commencing time $T_2$ of the firing of the furnace body 1. Accordingly, the temperature $t_6$ of the floor 2 immediately rises after the time $T_1$, and the firing of the burners of the furnace body 1 commences at the time $T_2$, at which the floor 2 is heated to a temperature being 50 degrees C. higher than a temperature $t_5$ of the furnace body 1. Although the rising of the temperature $t_6$ of the floor 2 precedes the rising of the temperature $t_5$ of the furnace body 1, the temperature difference between the floor 2 and the furnace body 1 becomes gradually smaller, and the temperature $t_6$ of the floor 2 and the temperature $t_5$ of the furnace body 1 become equal to each other after a time $T_3$. Then, the both temperatures uniformly rise. As a result, the substantially uniform temperature distribution of ambient temperatures within the furnace chamber can be accomplished in the furnace body 1 and the floor 2.

The time difference between the firing of the radiant tubes in the floor 2 and the furnace body 1 are greatly varied in accordance with the temperature of the floor 2, the heat capacity and shape of the article to be fired, etc. Therefore, the temperature control throughout the furnace chamber can easily be performed by commencing the firing of the burners for the radiant tubes 3*a* and 3*b* in the furnace body 1 after the floor 2 is heated to provide a temperature difference of a predetermined value from the temperature of the furnace body 1. In this embodiment, the temperature difference is set to 50 degrees C. That is, the temperature difference ($t_6$–$t_5$) between the temperature $t_6$ of the floor 2 and the temperature $t_5$ of the furnace body 1 at the commencing time $T_3$ of the firing of the furnace body 1 is 50 degrees C.

Although the setting value of the temperature difference is varied in accordance with the property of the furnace, it is preferable to set such value within the range of ½ to 1 times the temperature difference within the furnace chamber which is produced in case of that the burners of the radiant tubes 3*a* and 3*b* in the furnace body 1 and the radiant tubes 3*c* in the floor 2 are simultaneously fired to heat the furnace chamber.

If the value is in excess of one time, the air heated on the floor 2 moves upward, and then causes the temperature up of the furnace body 1. As a result, it is likely that the temperature difference of more than one time can not be obtained. On the contrary, if the value is less than ½ times, the desirable effect via the independent and previous firing of the burners for the radiant tubes 3*c* in the floor 2 can not be produced. The temperature control is performed under program control by using the combination of a personal computer and a controller.

It is common, in the furnace, to agitate the inside of the furnace chamber to omit the temperature difference in the vertical direction of the furnace chamber. On the contrary of this solution to the temperature difference, in accordance with the furnace of the present invention where the agitation is not performed, the temperature difference in the vertical direction can be omitted by giving a predetermined amount of offset in setting temperatures of the floor 2, the side wall 5 and the top wall 4, that is, by providing a predetermined value of temperature difference between the floor 2, the side wall 5 and the top wall 4 in setting the temperature of these portions.

It is preferable to set the amount of offset within a range of ½ to 1 times the temperature difference within the furnace chamber which is produced in case of heating the furnace chamber without giving the o determined in consideration of the following fact.

That is, when the amount of offset is less than ½ times the temperature difference within the furnace chamber, the temperature difference in the vertical direction is undesirably caused. On the contrary, when the amount of offset is in excess of one time, it is likely that the temperature difference of a preferable value can not be obtained due to the air which is heated on the floor 2 and moves upward.

The setting of the amount of offset will be described with reference to FIG. 10. Initially, the temperature rise at the side of the floor 2 is delayed as compared with that at the side of the furnace body 1. The temperatures of both sides, then, come closer to setting temperatures, and the firing control commences. In this regard, a setting temperature $t_3$ of the floor 2 is higher than a setting temperature $t_4$ of the furnace body 1, in which the temperature difference between $t_3$ and $t_4$ is the amount of offset. Therefore, the temperatures of the floor 2 and the furnace body 1 become equal to each other, and the temperature of the floor 2, then, becomes higher than the temperature of the furnace body 1. However, since the heated air moves upward, the temperatures at the sides of the floor 2 and the furnace body 1 can become substantially equal to each other, and the uniform temperature distribution of ambient temperatures within the furnace chamber can be obtained. This is also apparent from the fact that the temperature $t_1$ of the upper portion of the article becomes equal to the temperature $t_2$ of the lower portion of the article.

This temperature control is also performed under program control by using the combination of the personal computer and the controller. In this embodiment, the floor 2 is controlled to a temperature being higher than that of the top wall 4 by 20 degrees C. This control is effective for the furnace chamber where the agitation is prohibited.

In accordance with the batch type furnace, the article must be placed into and out of the furnace chamber for every firing operation. At this time, heat is likely to escape from the furnace chamber. However, the furnace of the present invention which includes the furnace body 1 of a substantially bell shape allows heat in the furnace body 1 to remain there, and heat from the floor 2 to rise and be transferred into the furnace body 1. Accordingly, there is little chance that heat escapes from the furnace chamber, and therefore heat left inside of the furnace body 1 can be utilized at the beginning of the subsequent heating process. As a result, heat loss can be minimized.

As described above, each radiant tube is provided at both open ends thereof with the burners so that each radiant tube can be heated from both open ends thereof. In this embodiment, the burners of each radiant tube are alternately fired. This arrangement is advantageous in the fact that the temperature lowering at the side which is opposite to the side where the burner is fired can be more effectively avoided as compared with the arrangement where the radiant tube is heated at either open end. This is suitable for providing the uniform temperature distribution within the furnace chamber.

Further, the incorporation of the heat reserving members in the burners of the radiant tubes allows the exhaust heat to be recovered and then utilized to feed the air of a high temperature for the combustion. That is, when the air for the combustion is heated to a high temperature, the amount of oxygen required for the combustion can be reduced. Accordingly, a stable combustion can be obtained, even if a large amount of the exhaust gas is introduced, while limiting air required for the combustion to a lower amount.

When the combustion is performed under a lower amount of oxygen where a larger amount of the exhaust gas and a lower amount of air are introduced, a long flame is produced and the peak temperature of the flame is lowered. Thereby, the temperature difference between the area near the active burner and the area far from the active burner becomes smaller, and a lesser amount of NOx is generated so that air pollution can be avoided. In addition, the lowering of the peak temperature of the flame allows the radiant tube of the heat resistant alloy to be used for a prolonged period of time.

Further, the combination of the exhaust heat recovery and the exhaust gas recirculation can reduce the heat loss to 15%. On the contrary, in case of that the exhaust heat recovery and exhaust gas recirculation are not performed, the heat loss of the exhaust gas is 40 to 50%. Thus, the heat loss of the exhaust gas can be reduced. The combination of the exhaust heat recovery and the exhaust gas recirculation can improve energy efficiency, provide uniform temperature distribution within the furnace chamber, suppress the generation of NOx, extend the life time of the radiant tube, and produce other effects.

Although the heat resistant alloy with nickel, chromium and tungsten is used as a material for the radiant tubes 3*a*, 3*b* and 3*c* in the embodiment given above, it is not necessary to limit the material for the radiant tubes 3*a*, 3*b* and 3*c* to such alloy. An alloy with nickel and other metals, Fe—Cr heat resistant alloy, and the like can be used. However, in consideration of the mechanical strength at a relatively high temperature, the distortion resistance during the heating and cooling operation, and the oxidation resistance, the alloy with nickel, chromium and tungsten exhibits the most excellent properties.

In the above embodiment, the radiant tubes 3*a*, 3*b* and 3*c* are arranged so that the radiant tube 3*a* in the top wall 4 are equivalent to 10% of the gross combustion energy, the radiant tubes 3*b* in the side wall 3*b* are equivalent to 60% and the radiant tubes 3*c* in the floor 2 are equivalent to 30%. This arrangement was determined in consideration of that the vessel 6 is fired. More specifically, the radiant tubes 3*c* which are equivalent to 30% of the gross combustion energy were arranged in the floor 2 in consideration of that the support 7 and the vessel 6 are mounted on the floor 2. That is, the radiant tubes 3*a*, 3*b* and 3*c* can be arranged in various proportions in accordance with the kind of the article to be fired.

In the above embodiment, the radiant tubes are respectively arranged in the top wall 4, the side wall 5 and the floor 2. However, it is not essential to arrange the radiant tubes in each of the top wall 4, the side wall 5 and the floor 2. It is possible to arrange the radiant tubes in limited portions, for example, the side wall 5 of the furnace body 1 and the floor 2, while not arranging them in the top wall 4. It is essential to arrange the radiant tubes in the furnace body 1 and the floor in such a manner as to be substantially and uniformly arranged throughout the entire furnace chamber.

In the above embodiment, by forming the furnace body 1 into the bell shape, the preferable results as described above are attainable. However, it is not essential to limit the shape of the furnace body 1 to the bell shape. The furnace body 1 of varying shape may be employed.

As described in the above embodiment, the weight of the furnace body 1 can be reduced by employing the ceramic wool as the insulation material therein, However, the insulation material is not limited to the ceramic wool, and it is not essential to provide the insulation material in the furnace of the present invention.

In the above embodiment, the radiant tubes 3*a*, 3*b* and 3*c* in the top wall 4, the side wall 5 and the floor 2 which are respectively and freely supported by the support fixtures 8, 11 and 12 are unlikely to crack. Accordingly, it is not necessary to scrap and replace the fixing portion of the support fixtures due to the cracking. This is advantageous over the conventional arrangement where the radiant tubes are welded to be fixed in position, with the result that they are likely to crack along a welding seam and around that portion due to fatigue resulted from temperature stress at the time of quick heating and cooling during a prolonged period of time.

It is possible to employ a varying type of fuel for the burner of the radiant tubes, which includes gases such as natural gas and coke gas, and liquid fuel such as heavy oil, light oil and kerosene.

In the above embodiment, the furnace of a so-called floor elevation type that the floor 2 can be elevated towards the furnace body 1 is employed. However, it is not necessary to limit the furnace to this type. It is possible to employ the furnace of a so-called furnace body elevation type that the furnace body can be lowered towards the floor 2.

This specification is by no means intended to restrict the present invention to the preferred embodiments set forth therein. Various modifications to the furnace for firing the glass-lined product, as described herein, may be made by those skilled in the art without departing from the spirit and scope of the present invention as defined in the appended claims.

What is claimed is:

1. A batch type furnace for firing an article with a glass surface thereon, comprising:

a furnace body;

a floor being removably attachable to the furnace body via a relative motion between the floor and the furnace body for forming a furnace chamber, within which said article is position and fired; and radiant tubes being substantially uniformly arranged in the furnace body and the floor, said radiant tubes being fed with combustion gas from a burner and controllable to a predetermined temperature independently of each other, and said radiant tubes being made of an alloy having a heat resistance of such a degree as to tolerate quick heating and cooling.

2. A furnace as set forth in claim 1, wherein said alloy includes nickel, chromium and tungsten.

3. A furnace as set forth in claim 1, wherein said furnace body is formed into a substantially bell shape.

4. A furnace as set forth in claim 1, wherein said radiant tubes arranged in the floor are heated before said radiant tubes arranged in the furnace body are heated.

5. A furnace as set forth in claim 1, wherein the floor is controlled to a temperature being higher than that of the furnace body.

6. A batch type furnace for firing an article with a glass surface thereon, comprising:

a furnace body including a side wall and a top wall;

a floor being removably attachable to the furnace body via a relative motion between the floor and the furnace body for forming a furnace chamber, within which said article is position and fired; and radiant tubes being substantially uniformly arranged in the side wall, the top wall and the floor, said radiant tubes being fed with combustion gas from a burner and being controllable to a predetermined temperature independently of each other, said radiant tubes being made of an alloy having a heat resistance of such a degree as to tolerate quick heating and cooling.

7. A furnace as set forth in claim 6, wherein said alloy includes nickel, chromium and tungsten.

8. A furnace as set forth in claim 6, wherein said furnace body is formed into a substantially bell shape.

9. A furnace as set forth in claim 6, wherein said radiant tubes arranged in the floor are heated before said radiant tubes arranged in the furnace body are heated.

10. A furnace as set forth in claim 6, wherein the floor is controlled to a temperature higher than that of the furnace body.

11. A batch type furnace for firing an article with a glass surface thereon, comprising:

a furnace body including a side wall and a top wall;

a floor being removably attachable to the furnace body via a relative motion between the floor and the furnace body for forming a furnace chamber, within which said article is position and fired; and radiant tubes being substantially uniformly arranged in the side wall and the floor, said radiant tubes being fed with combustion gas from a burner and controllable to a predetermined temperature independently of each other, said radiant tubes being made of an alloy having a heat resistance of such a degree as to tolerate quick heating and cooling.

12. A furnace as set forth in claim 11, wherein said alloy includes nickel, chromium and tungsten.

13. A furnace as set forth in claim 11, wherein said furnace body is formed into a substantially bell shape.

14. A furnace as set forth in claim 11, wherein said radiant tubes arranged in the floor are heated before said radiant tubes arranged in the furnace body are heated.

15. A furnace as set forth in claim 11, wherein the floor is controlled to a temperature higher than that of the furnace body.

* * * * *